US005797755A

United States Patent [19]

Montgomery

[11] Patent Number: 5,797,755

[45] Date of Patent: Aug. 25, 1998

[54] MERCHANDISE DISPLAY SYSTEM AND METHOD

[75] Inventor: Holliday S. Montgomery, Peachtree City, Ga.

[73] Assignee: Goody Products, Inc., Peachtree City, Ga.

[21] Appl. No.: 718,924

[22] Filed: Sep. 25, 1996

[51] Int. Cl.[6] ..... G09B 1/06

[52] U.S. Cl. ..... 434/429; 434/430

[58] Field of Search ..... 434/430, 429, 434/428, 171, 172; 40/657

[56] References Cited

U.S. PATENT DOCUMENTS

| | | | |
|---|---|---|---|
| 1,268,440 | 6/1918 | D'olier, Jr. | 434/430 |
| 1,269,384 | 6/1918 | Campbell | 434/429 |
| 1,491,536 | 4/1924 | Kautman | 273/272 |
| 1,506,156 | 8/1924 | Bjorklund-Asperen | 434/429 |
| 1,882,015 | 10/1932 | Huebsch | 40/657 |
| 2,474,447 | 6/1949 | Wheelock | 434/172 |
| 2,972,821 | 2/1961 | Bond | 434/429 |
| 3,596,388 | 8/1971 | Shorten | 40/657 |
| 3,873,093 | 3/1975 | Beskrone | 273/272 |
| 4,788,784 | 12/1988 | Templin | 40/657 |
| 5,145,377 | 9/1992 | Tarvin et al. . | |
| 5,533,902 | 7/1996 | Miller | 434/428 |

FOREIGN PATENT DOCUMENTS

| | | | |
|---|---|---|---|
| 830480 | 3/1960 | United Kingdom | 434/428 |

*Primary Examiner*—Paul J. Hirsch
*Attorney, Agent, or Firm*—Foley & Lardner

[57] ABSTRACT

A merchandise display system and method for related types of products in which each product is provided with a package bearing an icon indicating the type of product and its intended use, and an indicia of the quality of the product. A display is provided which includes panels setting forth the icons, and literal descriptions thereof, and which provides for arranging the product packages in rows and columns based upon the icon and indicia of quality on each package.

16 Claims, 7 Drawing Sheets

MERCHANDISE DISPLAY SYSTEM AND METHOD

BACKGROUND OF THE INVENTION

This invention relates to a merchandise display system and method, and the components thereof, for related types of products wherein the products of each type may have different intended uses and may be of different qualities.

Coordinated packaging of products has been used in the past by manufacturers to identify products of the same quality group. Further, products so packaged have been organized in retail establishments such that products of the same quality are grouped together, and are typically displayed near other products of the same type but of a different quality. Further, manufacturers of product lines have, in the past, provided retailers with display systems for organizing their products for sale, such that the retailer will present the products in an organized manner. More particularly, such display systems have provided designated spaces for certain of the manufacturers products, such that the retailer will be encouraged to display each of the manufacturers products in a desired quantity and in a desired arrangement.

SUMMARY OF THE INVENTION

It is an object of this invention to provide a merchandise display system and method, and the components thereof, whereby products of the same type, but having different intended usages may be organized for display with products of a different, but closely related type which also have different intended usages.

It is a further object of the invention to provide a system and method, and the components thereof, for identifying and organizing families of related types of products, of different qualities, with family members being intended for different uses.

It is a still further object of the invention to include, as components of the system, an attention grabbing component for attracting a potential customer's eyes to the display.

It is still another object of the invention to provide a header for the merchandise display which will familiarize a customer with the arrangement of the products, and assist the retailer in arranging the display of the products.

In accordance with this invention, a merchandise display system and method is provided using a plurality of components, each of which bears icons indicative of the type and use of a product and an indicia of quality of that product. Each product is identified by an icon, preferably consisting of at least two pictorial elements. A first pictorial element indicates the type of the product and the second pictorial element indicates the intended use of the product. The components of the system include the individual packaging for the products, including the icons indicating the type and use of the product and its quality, for the purpose of advising a prospective purchaser of the meanings of the icons and indicia quality, to aid the prospective purchaser in selecting a desired product, and to serve as a guide for arranging the products on the display. Another component of the system, an attention grabbing unit, is intended to draw a potential customers attention to the display and the products displayed thereon. The attention grabbing unit also bears the icons and indicia of quality to familiarize the customer with the product lines, and their use, and quality in accordance with the organizing system. Still another component of the system is a header which bears icons and indicia of quality of the merchandise, such that a potential customer may use the icons, and indicia quality, included on the product packaging to select a product of the desired quality, for a desired intended use.

DETAILED DESCRIPTION OF THE PREFERRED EMBODIMENT

Figure 1:
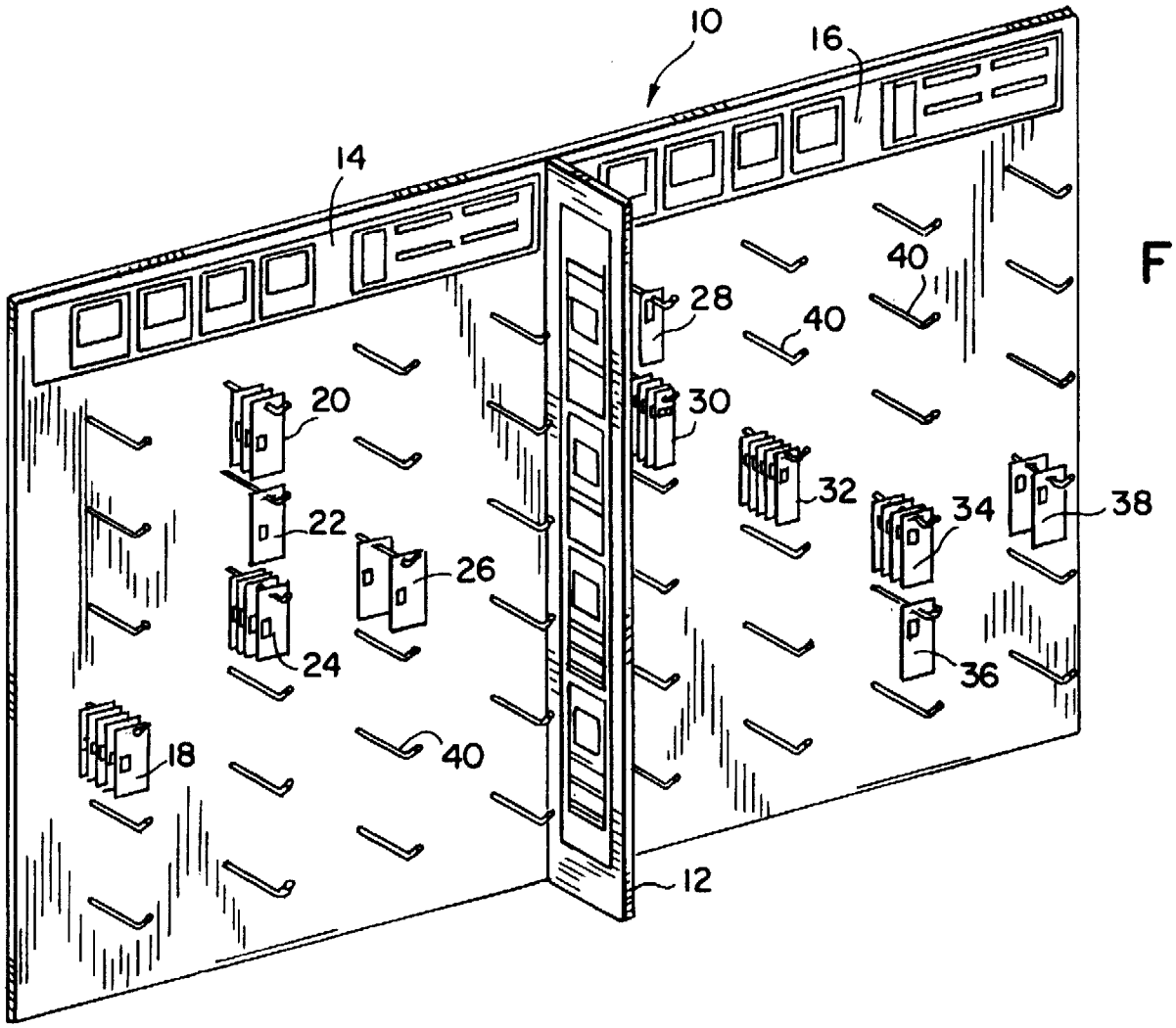
FIG. 1 is a perspective view of a complete merchandise display system and method in accordance with this invention.

Referring to FIG. 1, a complete merchandising display system and method, and the components thereof, in accordance with this invention is shown. A first component of a merchandise display system 10 in accordance with this invention is a two sided attention grabbing panel 12 which projects into the aisle of the store and is referred to as an "aisle talker". A second major component of the merchandise display system 10 is a pair of header panels 14 and 16, located at the top of the display, preferably at normal reading height for a standing potential customer. The third major component of the merchandise system 10 is the individual display package associated with each of the individual products, including those identified with the numerals 18, 20, 22, 24, 26, 28, 30, 32, 34, 36, and 38. Each of the individual product packages, 18 through 38, may in a typical fashion, be supported on a peg projecting from a peg board. As is the usual custom, only identical products are supported on the same peg. That is, all of the display packages hung on the peg supporting the display package 18 are identical and contain identical products. While only some of the pegs 40, are shown supporting display packages and are identified by numerals, a retail store using the display would find it advantageous to keep all of the pegs full of display packages to encourage sales.

Referring to the remaining FIGURES, the merchandising display system and method and components thereof will be described as applied to hair care products, including brushes and combs.

Figure 2:
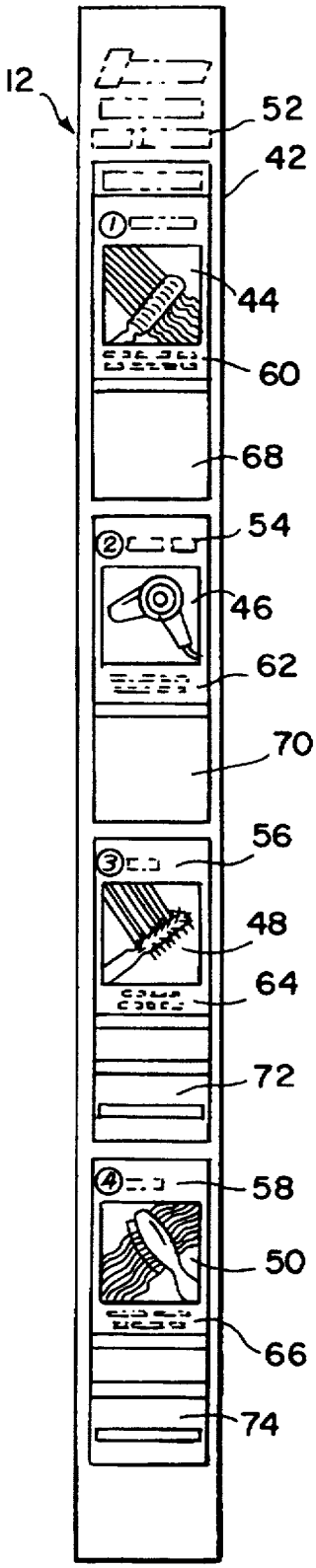
FIG. 2 is a plan view of a first attention grabbing component of the system.

Depicted in FIG. 2 is a plan view of a first side 42 of attention grabbing panel or aisle talker 12. The plan view illustrates icons used to identify various types of hair brushes. Four icons 44, 46, 48, and 50 are shown. Icon 44 is used to represent brushes intended for use in detangling hair. Icon 46 is used to represent brushes intended for use when blow drying hair. Icon 48 is used to represent brushes intended for use in curling hair, and icon 50 is used to represent brushes intended for use in styling hair. Above each icon 44 through 50 is a word or words identifying the use of the product suggested by the icon. Thus, associated with the icon 44, used to identify brushes intended for detangling hair, is the word "detangle", represented by the rectangle 52. Similarly, the icon 46, used to identify brushes intended for use in blow drying hair, is associated with the words "blow dry", represented by the rectangle 54. The icon 48, used to identify brushes intended for curling hair, is associated with the word "curl", represented by the rectangle 56. Finally, the icon 50, used to identify brushes intended for styling hair, is associated with the word "style", represented by the rectangle 58.

In addition to the above-mentioned principal elements, the first side 42 of aisle talker 12 includes further written description of each of the products types identified with the icons 44 through 50. This further written description is represented by the reference numeral 60, (that is unintelligible marks designating a word or words) for the detangle icon 44. Further written description for the blow dry icon 46 is represented by the reference numeral 62, for the curl icon 48 by the reference numeral 64, and for the style icon 50 by the reference numeral 66. More detailed comments on the features and use of the product types are set forth at 68 for icon 44, at 70 for icon 46, at 72 for icon 48, and at 74 for icon 50. Thus, after viewing the first side 42 of aisle talker 12, a person in need of a brush for a particular purpose will know which icon to look for on the individual product display packages.

Figure 3:
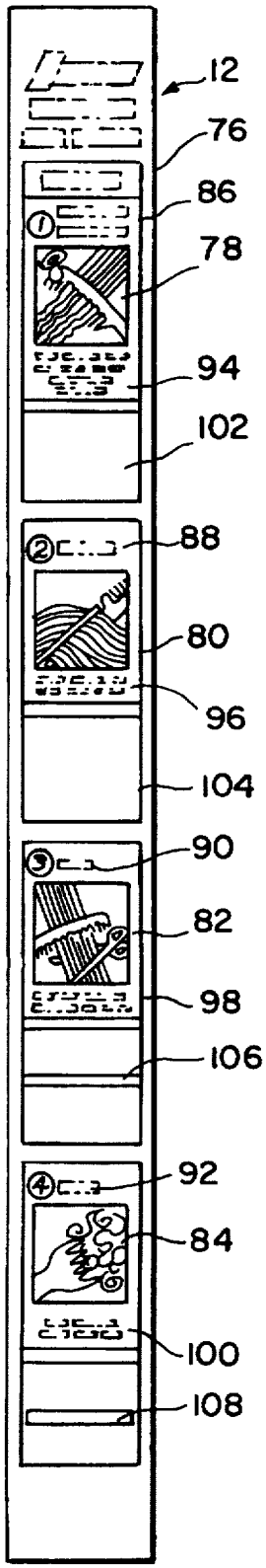
FIG. 3 is a plan view of a second attention grabbing component of the system.

Depicted in FIG. 3, is a plan view of the second side of 76 of the attention grabbing panel or aisle talker 12. The plan view illustrates icons used to identify various types of hair combs. Four icons 78, 80, 82, and 84 are shown. Icon 78 is used to represent combs intended for use in detangling hair. Icon 80 is used to represent combs intended for sectioning hair. Icon 82 is used to represent combs intended for use in trimming hair, and icon 84 is used to represent combs intended for use in finishing hair. Above each icon 78 through 84 is a word or words identifying the use of the comb suggested by the icon. Thus, associated with the icon 78, used to identify combs intended for detangling hair, is the word "detangle", represented by the rectangles 86. Similarly, the icon 80, used to identify combs intended for use in sectioning hair, is associated with the word "section", represented by the rectangle 88. The icon 82, used to identify combs intended for trimming hair, is associated with the word "trim", represented by the rectangle 90. Finally, the icon 84, used to identify combs intended for finishing hair, is associated with the word "finish", represented by the rectangle 92.

In addition to the above-mentioned principal elements, the second side 68 of aisle talker 12 includes further written description of each of the combs identified with the icons 78 through 84. This further written description is represented by the reference numeral 94 for the detangle icon 78, by the reference numeral 96 for the section icon 80, by the reference numeral 98 for the trim icon 82, and by the reference numeral 100 for the finish icon 84. More detailed comments on the features and use of each of the product types is set forth at 102 for icon 78, at 104 for icon 80, at 106 for icon 82, and at 108 for icon 84. Thus, after viewing the second side 76 of aisle talker 12, a person in need of a comb for a particular purpose will know which icon to look for on the individual display packages for combs.

Figure 4:
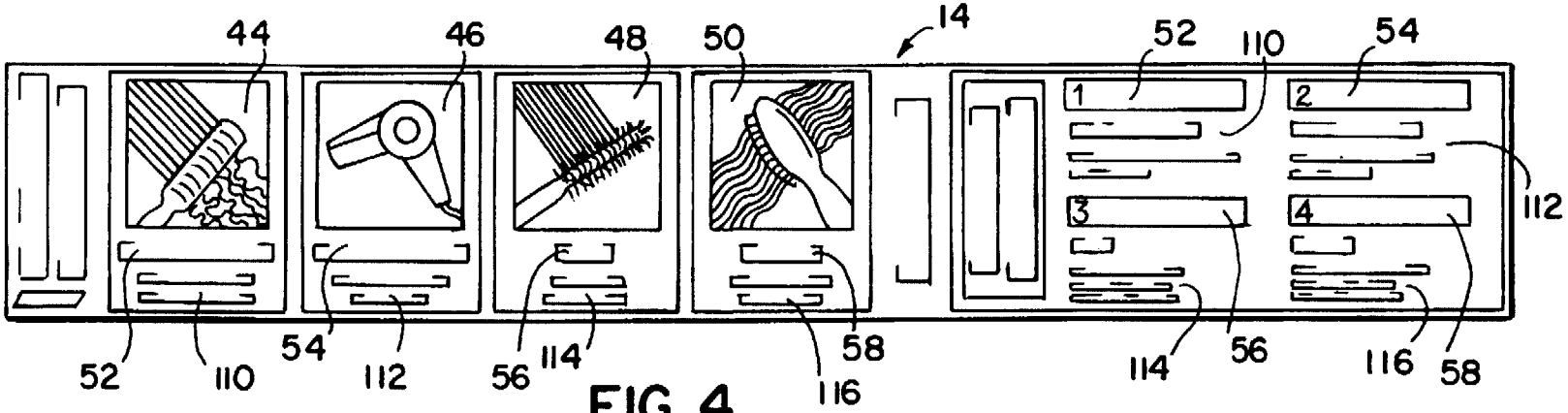
FIG. 4 is a plan view of a first header for the display.

Referring now to FIG. 4, the header panel 14 for brushes is shown. The header panel depicts the same icons for brushes as set forth on the first side 42 of the aisle talker 12. That is, icon 44 for brushes for detangling hair, icon 46 for brushes for blow drying hair, icon 48 for brushes for curling hair and icon 50 for brushes for styling hair. Further, the same identifying word or words associated with each of the icons on the first side 42 of the aisle talker 12 is also set forth below each icon on the header panel 14 as represented by the rectangles 52 through 58 for the icons 44 through 50 respectively. The further written descriptions represented by the reference numeral 60 through 66 for icons 44 through 50 on the first side 42 of aisle talker 12, are set forth below the identifying word or words represented by the rectangles 52 through 58, as represented by the rectangles 110 through 116 respectively.

The identifying word or words for icons 44 through 50 represented by the rectangles 52 through 58 respectively are also set forth at the right end of header panel 14, along with the further written descriptions represented by the rectangles 110 through 116. Thus, ready reference may be made to the icons and the written description by a potential purchaser to identify the brush or brushes which are desired for a particular purpose.

Figure 5:
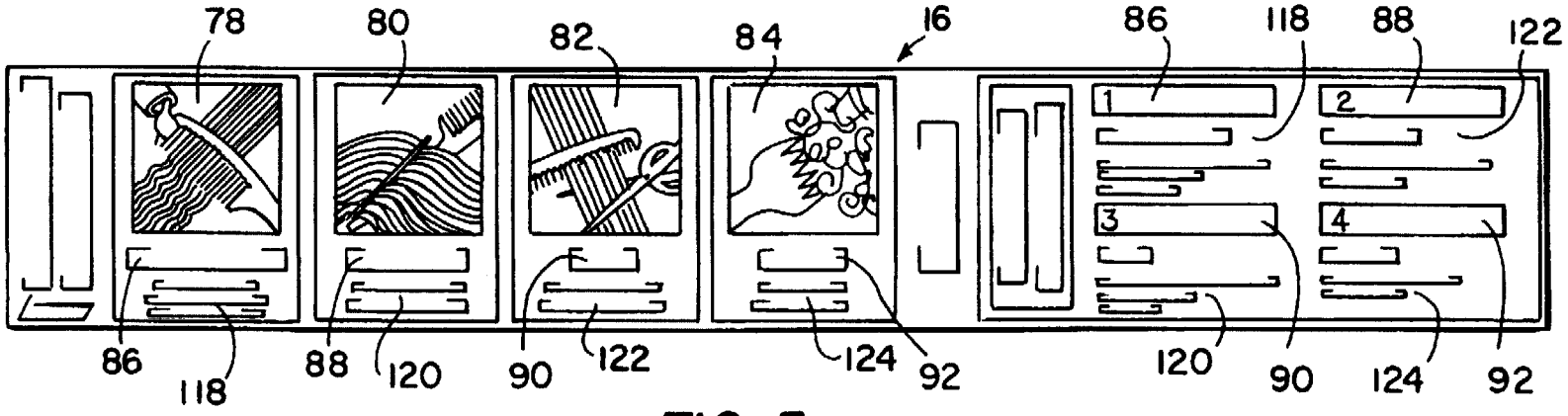
FIG. 5 is a plan view of a second header for the display.

Referring now to FIG. 5, the header panel 16 for combs is shown. As in the case of the header panel 14 for brushes, the same icons for combs as set forth on the second side 76 of the aisle talker 12 are shown. That is, icon 78 for combs for detangling hair, icon 80 for combs for sectioning hair, icon 82 for combs for trimming hair and icon 84 for combs for finishing hair. Further, the same identifying word or words associated with each of the icons on the second side 68 of the aisle talker 12 is also set forth below each icon on the header panel 16 as represented by the rectangles 86 through 92 for the icons 78 through 84 respectively. The further written descriptions represented by the reference numeral 94 through 100 for icons 78 through 84 on the second side 76 of the aisle talker 12 are set forth below the identifying word or words represented by the rectangles 86 through 92, as represented by the rectangles 118 through 124.

The identifying word or words for icons 78 through 84 represented by the rectangles 86 through 92 respectively are also set forth at the right end of header panel 16, along with the further written description represented by the rectangles 118 through 124. Thus, ready reference may be made to the icons and the written descriptions by a potential purchaser to identify the comb or combs which are desired for a particular purpose or purposes.

Figure 6:
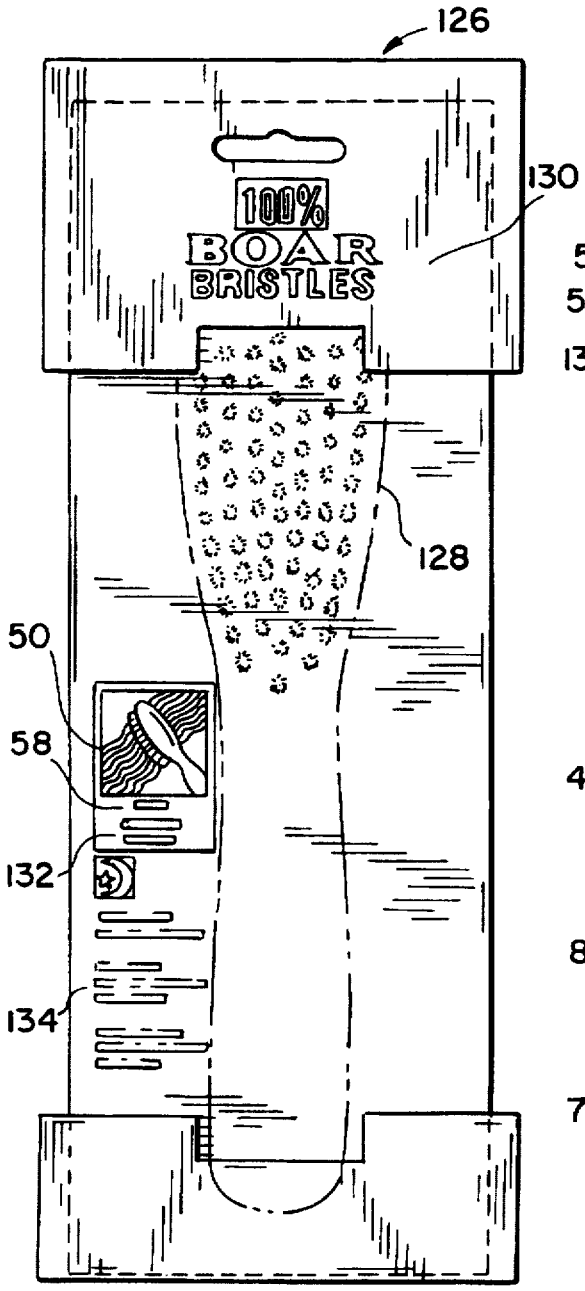
FIG. 6 is a plan view of a first example of the front side of a packaging for a product in accordance with the merchandising display system and method of this invention.

Making reference to FIG. 6, a display card for an individual product will now be described. The front of a card or package 126 for displaying a brush 128 includes the style icon 50, identifying the brush 128 as designed for use in styling hair. The package also includes an indication 130 of quality, which is set forth as "100% boar bristles". Thus, after having observed the first side 42 of aisle talker 12 and/or the header panel 14, the attention of a person stocking the display 10 or wishing to purchase a brush for styling, would immediately be drawn to the icon 50 on package 126 which identifies the brush 128 as intended for styling. Located immediately below the icon 50 is the word "style", represented by the rectangle 58. Wherein it is desirable to market the brush 128 to people literate is different languages, rectangles 132 immediately below rectangle 58 represent the word "style" in other languages such as French and Spanish. Represented by the rectangles 134 below the rectangles 132, is a description of the brush features defined by the indication 130 of quality.

Figure 7:
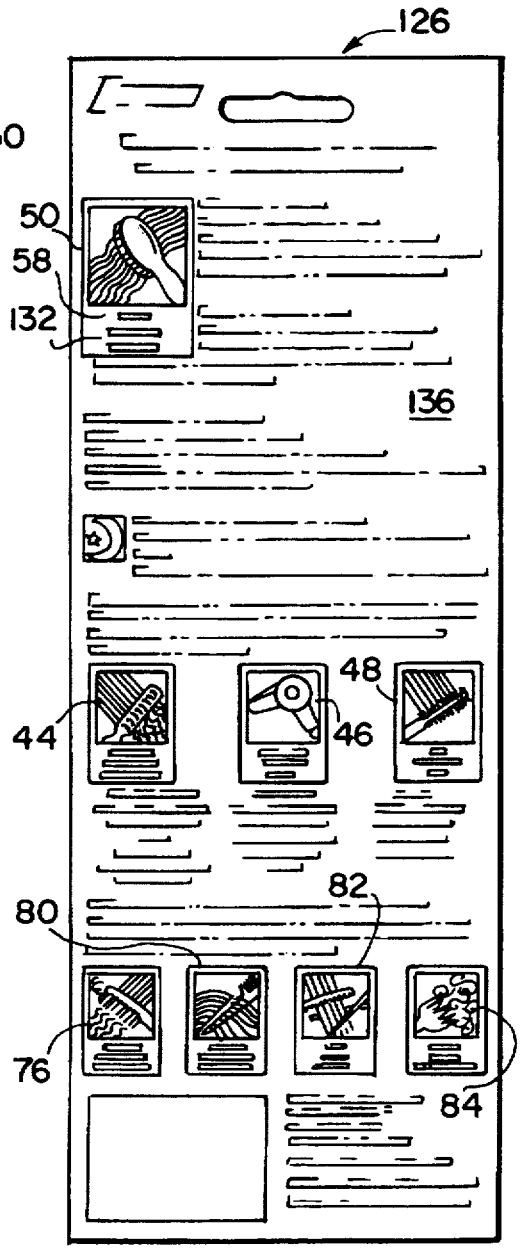
FIG. 7 is a plan view of the reverse side of the first example of the packaging for a product of FIG. 6.

The reverse side of the package or card 126 is shown in FIG. 7. The styling icon 50 is set forth near the top of the card. Located immediately below the icon 50 is the word "style", represented by the rectangle 58, and the word "style" in other languages such as French and Spanish as represented by the rectangles 132. A description of the brush and suggestion for its use are set forth to the right and below the styling icon 50 as represented by the rectangles 136. Also presented on the reverse side of the card are brush icons 44, 46 and 48, identifying other types of brushes, and icons 60, 62, 64 and 66 identifying the various types of combs. The related words and descriptions are included with the icons in the same arrangement as set forth in the header panels 14 and 16. Thus, a consumer having purchased the styling brush 128 would take home a description of the other types of brushes and combs, would become familiarized with the various icons, the products and their uses as represented by the icons, and would be encourage to purchase the products represented by the icons when passing a merchandise display system 10 in the future.

Figure 8:
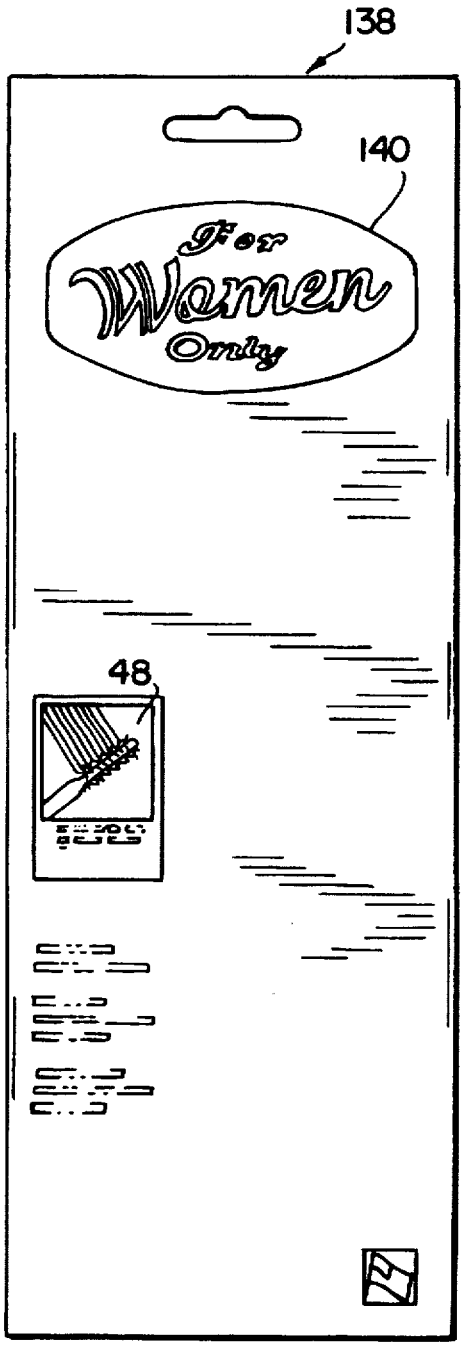
FIG. 8 is a plan view of a second example of the front side of a packaging for a product in accordance with the merchandising display system and method of this invention.
Figure 9:
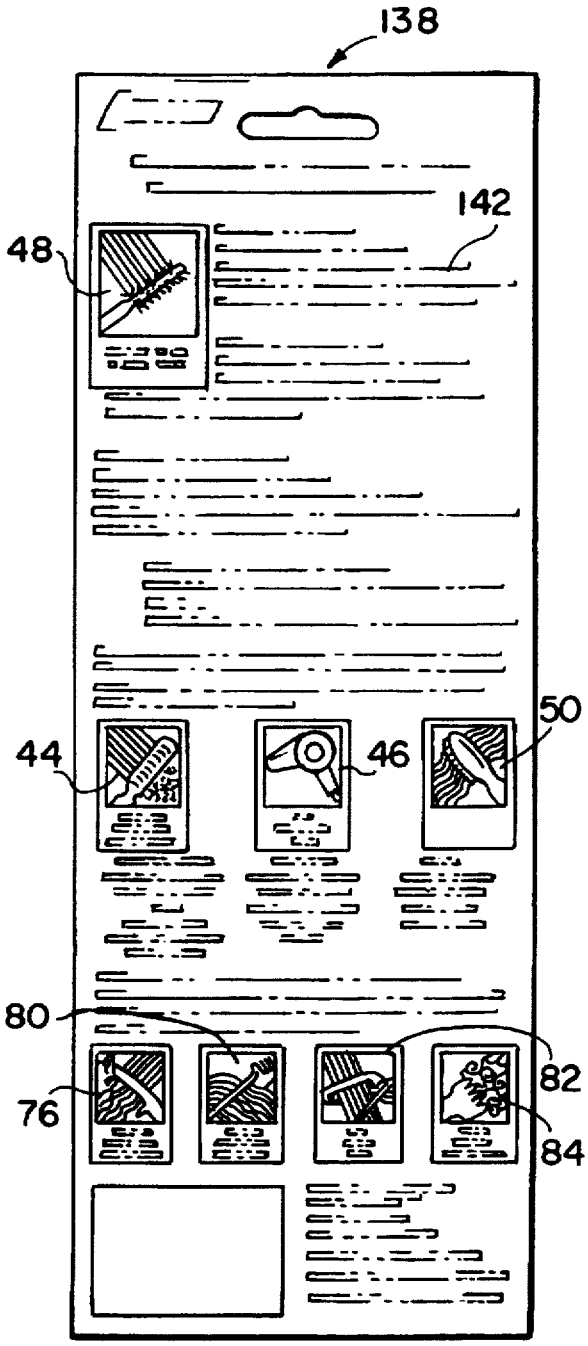
FIG. 9 is a plan view of the reverse side of the second example of the packaging for a product of FIG. 8.

Referring to FIG. 8, the front of a package or card 138 for a brush intended for curling is shown. Again, the packaging includes the curling icon 48 and also a product quality indicia 140 indicating it is of the quality line "For Women Only". The reverse side of the package 138 is shown in FIG. 9, and includes at the top the icon 48 identifying a brush intended for curling, and provides with it to the right and below the icon a full description of the use of that type of brush as represented by the rectangles 142. Again, the icons 44, 46, and 50, associated with the other types of brushes, and the icons 78 through 84 for combs are also included to acquaint the purchaser with the various types of combs and brushes and to encourage their purchase.

Figure 10:
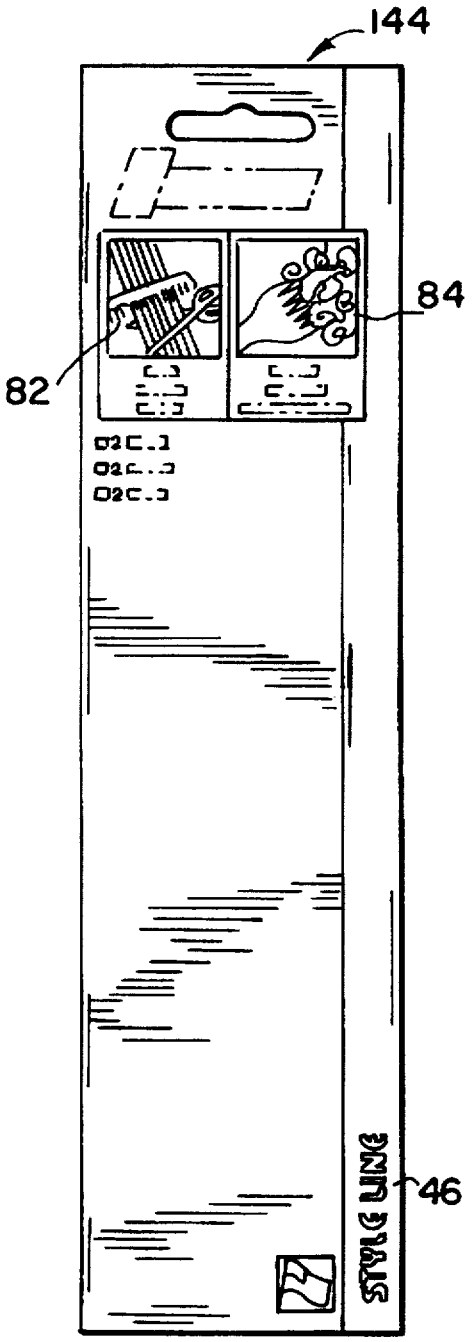
FIG. 10 is a plan view of a third example of the front side of a packaging for a product in accordance with the merchandising display system and method of this invention.
Figure 11:
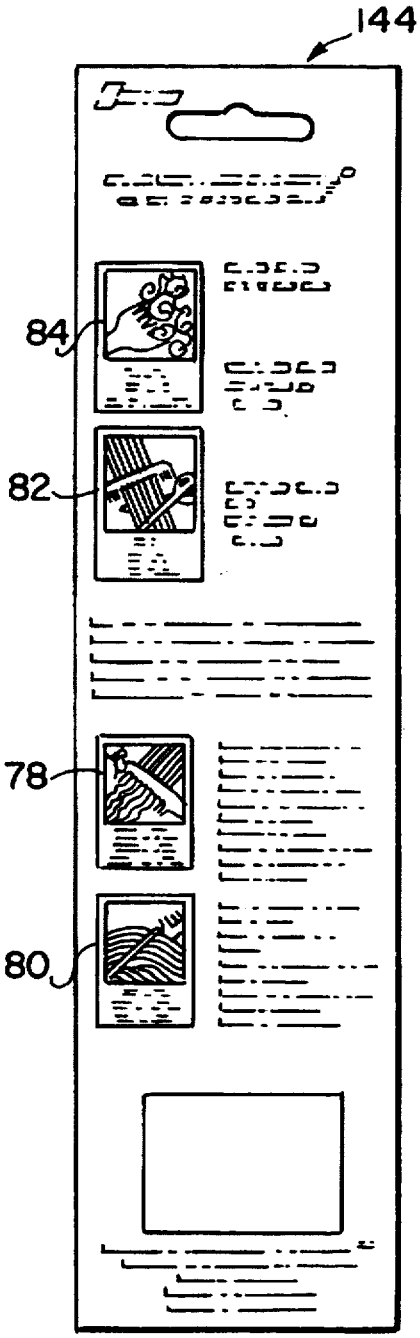
FIG. 11 is a plan view of the reverse side of the third example of the packaging for a product of FIG. 10.

Referring to FIG. 10, a display card or package 144 is depicted for a pair of combs having the intended purposes of trimming and finishing hair as identified by the icons 82 and 84 respectively. The identification of quality or product line is shown at 146 by the legend "Style Line". FIG. 11, shows the reverse side of the display card 144, which includes at the top the icons 82 and 84 for trimming and finishing hair respectively, and a full description thereof. Toward the bottom of the reverse side of the display card 136 are the icons 78 and 80 for other types of combs, that is detangling and sectioning respectively and a description thereof.

Figure 12:
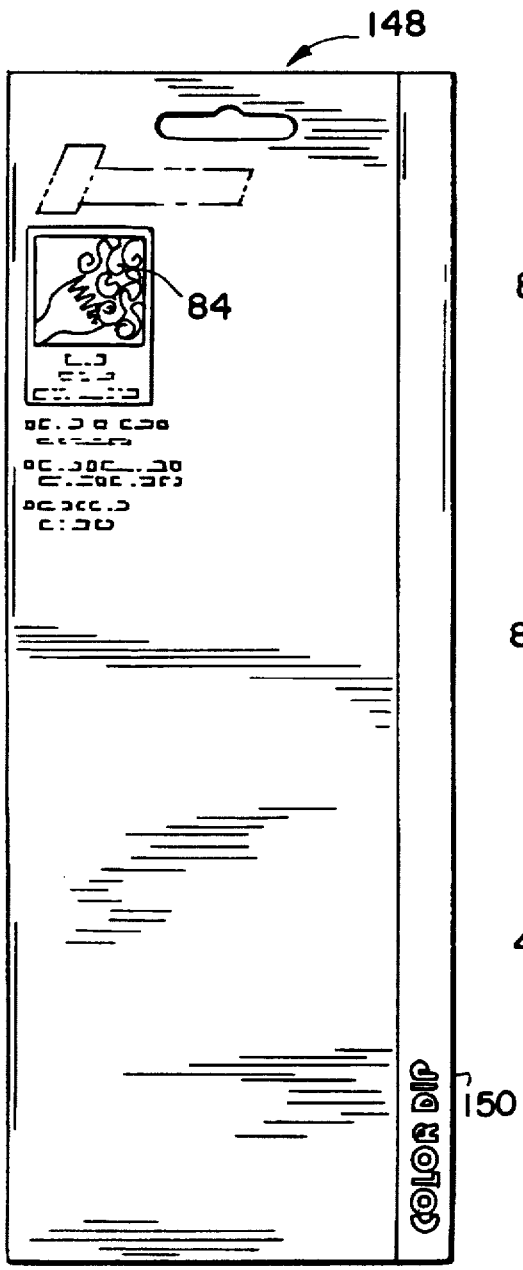
FIG. 12 is a plan view of a fourth example of the front side of a packaging for a product in accordance with the merchandising display system and method of this invention.
Figure 13:
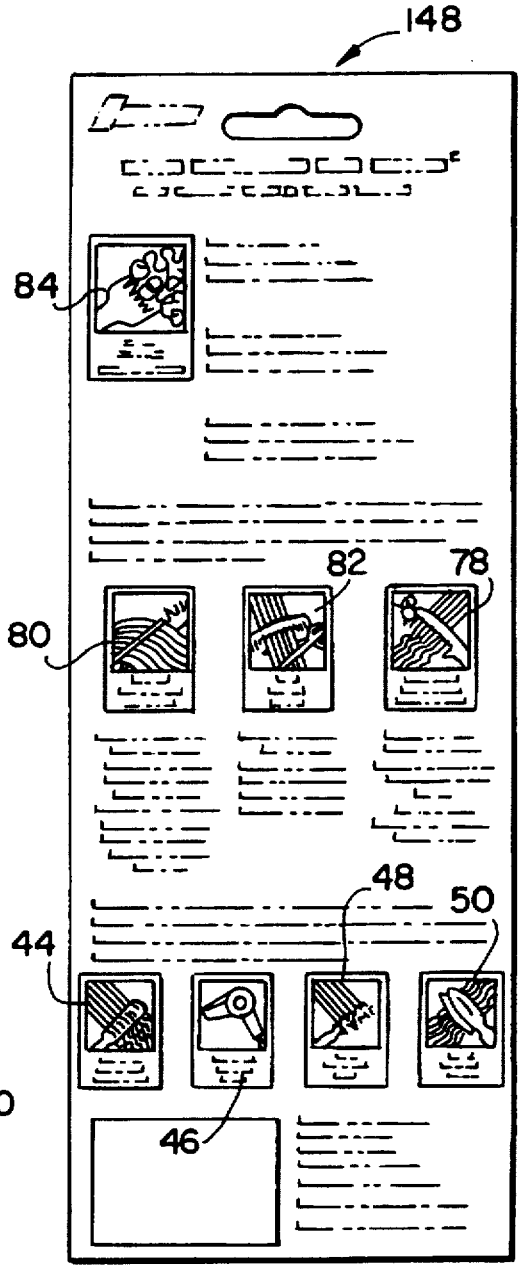
FIG. 13 is a plan view of the reverse side of the fourth example of the packaging for a product of FIG. 12.

FIG. 12 shows the front of a display card or package 148 for a comb intended for finishing as represented by the icon 84. The identification of quality or product line is shown at 150 by the legend "Color dip". FIG. 13, shows the reverse side of the display card 140, which includes at the top the icon 84 for finishing hair, and a full description thereof. Shown at the middle of the card are the icons 78, 80, and 82 for the other types of combs, that is detangling, sectioning, and trimming hair respectively. The icon 44 through 50 for brushes are shown at the bottom of the card.

The indicia of quality 130, 140, 146 and 150, set forth in FIGS. 6, 8, 10, and 12 respectively are used to distinguish a line or family of products of the same quality. That is, in addition to the "100% Boar Bristles" brush intended for styling, as displayed in package 126, the same indicia of quality would be used on packages containing the other three types of brushes identified by the icons 44, 46, and 48. Similarly, a family of products for different uses including both brushes and combs, identified by the icons 44 through 50 and 78 through 84, would be presented in packages bearing the indicia of quality 142 "For Women Only". Similarly families of products would bear the indicia of quality 146 "Style Line" and 150 "Color Dip". The quality of families of products are further distinguished from each other, by having similar indicia of quality such as 130 and 140 indicating the best quality families, and the similar indicia of quality such as 146 and 150 indicating the better quality families.

The products displayed in the merchandise display system 10, are typically arranged to take into account not only the product type, but also its intended use and quality. Referring to FIG. 1, brushes are arranged on the pegs to the left of the aisle talker 12, with each row of pegs containing brushes intended for the same purpose, i.e. having the same icon, and each column containing brushes of same quality family, i.e. being in packages being the same indicia of quality. Combs are similarly arranged on the right of the isle talker 12. In an alternate arrangement of the brushes and combs, those of the same quality could be presented in the same row, and those intended for the same purpose being placed in the same column. In the alternate arrangement, products of quality family which is most desirable to sell could be placed in the row or rows at the height most readily observed by most potential purchasers.

Summarizing, by identifying the icon associated with the use for which a brush or comb is being purchased, the purchasers may look for that icon on the product packages and then further refine their selection in accordance with the quality designation of the product such as the legend "100% boar bristles".

While the merchandising display system and method and the components thereof of this invention has been shown and described with respect to the merchandising of hair brushes and hair combs, it should be apparent to those skilled in the art that what has been described is considered at present to be a preferred embodiment of this invention. In accordance with the patent statutes, changes may be made in the merchandising display system and method and components thereof without actually departing from the true spirit and scope of this invention. The appended claims are intended to cover all such changes and modifications which fall in the true spirit and scope of this invention.

What is claimed is:

1. A merchandise display system comprising:

a plurality of articles of merchandise intended for sale, each article having a pictorial representation indicative of a feature or characteristic of quality of the article provided thereon in a manner such that the pictorial representation is plainly visible;

a plurality of pegs adapted to support the plurality of articles of merchandise in a manner so that the pictorial representations provided on the articles of merchandise are plainly visible;

a first display panel having a plurality of pictorial representations provided thereon corresponding to the pictorial representations provided on the plurality of articles, the first display panel being provided at a first angular orientation with respect to the pictorial representations provided on the plurality of articles of merchandise; and a second display panel having a plurality of pictorial representations provided thereon corresponding to the pictorial representations provided on the plurality of articles, the second display panel being provided at a second angular orientation with respect to the pictorial representations provided on the plurality of articles of merchandise, the pictorial representations provided on the articles of merchandise, and on the first and second display panels being coordinated with one another so that a potential purchaser can quickly and easily locate a particular article of merchandise with a desired feature or characteristic of quality as embodied in the pictorial representation.

2. A merchandise display system according to claim 1 and wherein the first display panel and second display panel are mounted substantially normal to one another.

3. A merchandise display system according to claim 1 and further comprising:

a particular written description provided on the plurality of articles of merchandise, the written description corresponding to a particular feature or characteristic of quality of said plurality of articles of merchandise, said particular written description also being provided on at least one of the first and second display panels.

4. A merchandise display system according to claim 3 wherein said particular written description is provided on both of the first and second display panels.

5. A merchandise display system according to claim 3 wherein a first portion of the plurality of articles of merchandise all include the same pictorial representation and a second portion of the plurality of articles of merchandise include a second pictorial representation, different from the first pictorial representation.

6. A merchandise display system according to claim 5 wherein the pegs are arranged in a matrix of rows and columns and the first portion of the plurality of articles are arranged on the pegs so that the pegs of one of the rows and columns support the first portion of the plurality of articles of merchandise and the other of the rows and columns of pegs support the second portion of the plurality of articles of merchandise.

7. A merchandise display system according to claim 6 wherein the pictorial representation comprises an icon indicative of the intended use of the article.

8. A merchandise display system according to claim 7 wherein the particular written description is indicative of the quality of the article.

9. A merchandise display system for a variety of haircare products comprising:

a pegboard having a plurality of pegs projecting outwardly therefrom;

a plurality of haircare products adapted to be supported on at least one of said plurality of pegs, the haircare products comprising packaging for containing the haircare product;

a plurality of different icons adapted to be provided on at least one of the haircare product and the packaging, each of the different icons being indicative of a feature or quality of the haircare product;

a plurality of written descriptions adapted to be provided on at least one of the haircare product and the packaging, each of the different written descriptions being indicative of a feature or quality of the haircare product; and a first display panel mounted substantially normal to the pegboard and having mounted thereon at least one of the plurality of icons and plurality of written descriptions;

a second display panel mounted to the pegboard at an angular orientation different from the first display panel, the second display panel having mounted thereon at least one of the plurality of icons and plurality of written descriptions.

10. A merchandise display system according to claim 9 wherein the pegs are mounted to the pegboard in a matrix of columns and rows.

11. A merchandise display system according to claim 10 wherein a first group of haircare products having the same icon provided thereon are supported on pegs aligned in one of the same row and column.

12. A merchandise display system according to claim 11 wherein a second group of haircare products having the same written description provided thereon are supported on pegs aligned in one of the same row and column.

13. A merchandise display system according to claim 12 wherein the haircare products comprise combs.

14. A merchandise display system according to claim 12 wherein the haircare products comprise hairbrushes.

15. A method of organizing and displaying articles of merchandise comprising the steps of:

providing a merchandise display system comprising:

a plurality of articles of merchandise intended for sale, each article having a pictorial representation indicative of a feature or characteristic of quality of the article provided thereon in a manner such that the pictorial representation is plainly visible;

a plurality of pegs adapted to support the plurality of articles of merchandise in a manner so that the pictorial representations provided on the articles of merchandise are plainly visible;

a first display panel having a plurality of pictorial representations provided thereon corresponding to the pictorial representations provided on the plurality of articles, the first display panel being provided at a first angular orientation with respect to the pictorial representations provided on the plurality of articles of merchandise; and a second display panel having a plurality of pictorial representations provided thereon corresponding to the pictorial representations provided on the plurality of articles, the second display panel being provided at a second angular orientation with respect to the pictorial representations provided on the plurality of articles of merchandise, the pictorial representations provided on the articles of merchandise, and on the first and second display panels being coordinated with one another so that a potential purchaser can quickly and easily locate a particular article of merchandise with a desired feature or characteristic of quality as embodied in the pictorial representation;

providing said plurality of pegs in a matrix of columns and rows mounting said articles of merchandise on said pegs in a manner so that a first portion of said articles having a common pictorial representation are supported on pegs aligned in one of the same row and column.

16. A method of organizing and displaying articles of merchandise according to claim 15 and further comprising the steps of:

providing a particular written description on the plurality of articles of merchandise, the written description corresponding to a particular feature or characteristic of quality of said plurality of articles of merchandise, said particular written description also being provided on at least one of the first and second display panels;

mounting said articles of merchandise on said pegs in a manner so that a second portion of said articles having a common written description are supported on pegs aligned in one of the same row and column.

* * * * *